US009490593B2

(12) United States Patent
Rois

(10) Patent No.: US 9,490,593 B2
(45) Date of Patent: Nov. 8, 2016

(54) CONNECTING PLUGS TO JACKS OF ELECTRONIC DEVICES

(71) Applicant: Stephen John Rois, Webster Groves, MO (US)

(72) Inventor: Stephen John Rois, Webster Groves, MO (US)

( * ) Notice: Subject to any disclaimer, the term of this patent is extended or adjusted under 35 U.S.C. 154(b) by 1 day.

(21) Appl. No.: 14/480,064

(22) Filed: Sep. 8, 2014

(65) Prior Publication Data

US 2016/0072236 A1 Mar. 10, 2016

Related U.S. Application Data

(60) Provisional application No. 62/046,096, filed on Sep. 4, 2014.

(51) Int. Cl.

| | |
|---|---|
| ***H04R 1/10*** | (2006.01) |
| ***H01R 24/58*** | (2011.01) |
| ***H04R 1/06*** | (2006.01) |
| ***H01R 13/62*** | (2006.01) |
| *H04R 25/00* | (2006.01) |

(52) U.S. Cl.

CPC ..... *H01R 24/58* (2013.01); *H01R 13/62* (2013.01); *H04R 1/06* (2013.01); *H04R 1/10* (2013.01)

(58) Field of Classification Search

CPC .... H01R 24/58; H01R 43/26; H01R 13/642; H04R 1/06; H04R 1/10

USPC ..... 381/74, 370, 384; 150/154; 206/320

See application file for complete search history.

(56) References Cited

U.S. PATENT DOCUMENTS

| | | | | |
|---|---|---|---|---|
| 6,979,231 | B2 | 12/2005 | Shinohara | |
| 7,258,579 | B2 | 8/2007 | Nam | |
| D582,389 | S | 12/2008 | Bose et al. | |
| D590,371 | S | 4/2009 | Leinvuo | |
| 8,162,697 | B1 | 4/2012 | Menolotto et al. | |
| D674,345 | S | 1/2013 | Izen et al. | |
| D684,117 | S | 6/2013 | Scarpa | |
| 2007/0241012 | A1* | 10/2007 | Latchford | A45C 11/00 206/320 |
| 2011/0081022 | A1* | 4/2011 | Tamm | H01R 13/6594 381/1 |
| 2011/0311040 | A1* | 12/2011 | Chen | H01R 13/625 379/420.02 |
| 2015/0055917 | A1* | 2/2015 | Liu | G02B 6/3816 385/94 |

FOREIGN PATENT DOCUMENTS

| | | |
|---|---|---|
| JP | 11-317256 | 11/1999 |
| JP | 2004-087185 | 3/2004 |
| JP | 2005-252579 | 9/2009 |

* cited by examiner

*Primary Examiner* — Vivian Chin
*Assistant Examiner* — Ammar Hamid
(74) *Attorney, Agent, or Firm* — Harness, Dickey & Piece, P.L.C.

(57) ABSTRACT

Disclosed are exemplary embodiments of plugs and related methods. In an exemplary embodiment, a plug generally includes a connector configured for insertion into a jack of an electronic device. The plug also includes an offset member whereby the plug is configured to fit snugly relative to a protective case of the electronic device.

20 Claims, 3 Drawing Sheets

CONNECTING PLUGS TO JACKS OF ELECTRONIC DEVICES

CROSS-REFERENCE TO RELATED APPLICATION

This application claims the benefit and priority of U.S. Provisional Patent Application No. 62/046,096 filed Sep. 4, 2014. The entire disclosure of the above application is incorporated herein by reference.

FIELD

The present disclosure relates to connecting plugs to jacks of electronic devices.

BACKGROUND

This section provides background information related to the present disclosure which is not necessarily prior art.

Headsets are extremely popular and can be seen in many places, e.g., in use by people listening to music, audio presentations and/or conversations on smart phones or other mobile devices.

SUMMARY

This section provides a general summary of the disclosure, and is not a comprehensive disclosure of its full scope or all of its features.

According to various aspects, exemplary embodiments are disclosed of plugs for connection to jacks of electronic devices. In an exemplary embodiment, a plug generally includes a connector configured for insertion into a jack of an electronic device. The plug also includes an offset member whereby the plug is configured to fit snugly relative to a protective case of the electronic device.

In another example embodiment, the disclosure is directed to a plug including a connector configured to connect with a jack of an electronic device, and an offset member configured to fit snugly in an opening of a protective case of the electronic device when the connector and the jack are connected through the opening.

Also disclosed are methods that generally include a method of connecting a plug with a jack of an electronic device. One example method includes inserting a connector of the plug into the jack through an opening in a protective case of the electronic device, and fitting an offset member of the plug snugly in the opening of the protective case.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The inventor hereof has recognized that signal interference frequently occurs during use of a headset connected to a mobile phone through a protective case in which the phone is installed. The user is often required to remove the protective case from the phone in order to stop the interference. It can be frustrating and annoying for the user to listen to a mobile phone under such conditions. The inventor has further observed that such interference can occur when a plug connecting a headset to a mobile phone through a protective case prevents a proper and secure electrical connection. Accordingly, the inventor has developed and discloses herein exemplary embodiments of a plug for connection to a jack of an electronic device.

It should be understood that although various embodiments are described with reference to headsets and mobile phones, the invention is not so limited. A plug having an offset member in accordance with various embodiments could be used in relation to various electronic devices and/or protective covers. Further, embodiments could be implemented in relation to various audio devices including but not limited to headsets, headphones, ear buds, adapters, splitters, extensions, etc. It also should be noted that a plug in accordance with various aspects of the disclosure can be used to connect an electronic device with an audio device regardless of whether or not the electronic device is installed in a protective case.

Figure 1:
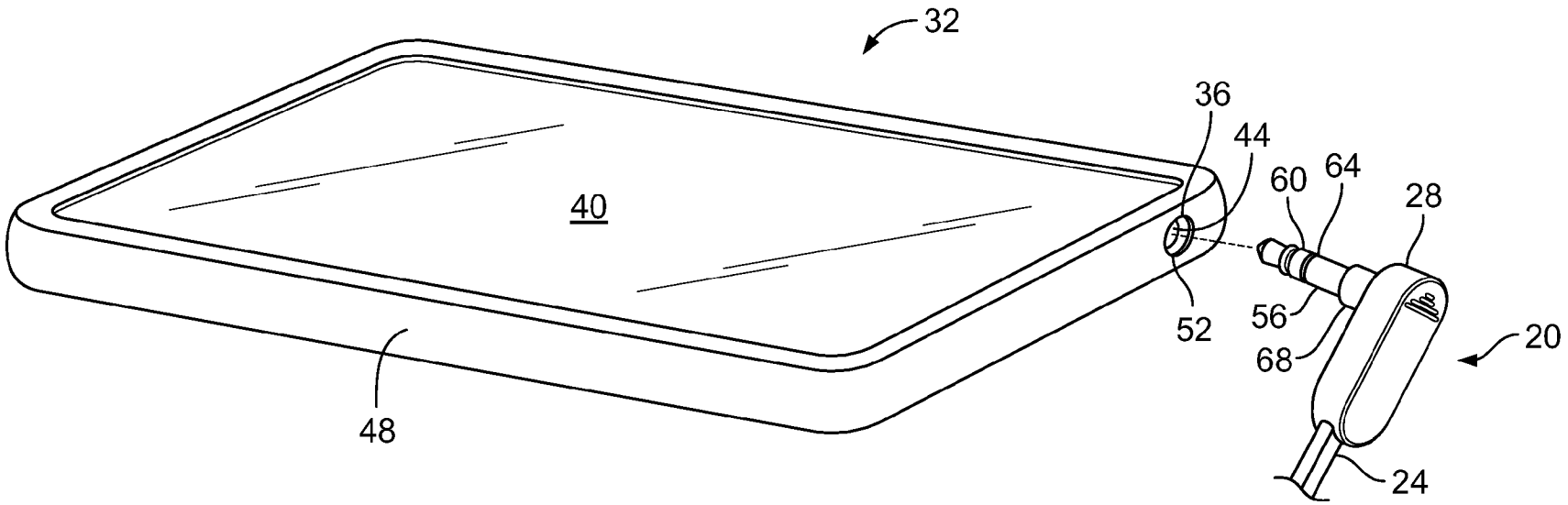
FIG. 1 is a perspective view of an electronic device and a plug in accordance with one example embodiment of the disclosure.

With reference now to the figures, FIGS. 1 and 2A-2F illustrate an exemplary embodiment of a plug 20 embodying one or more aspects of the present disclosure. As shown in FIG. 1, two coated wires 24 extend from a body 28 of the plug 20 for connection, e.g., with each of two earpieces of a headset (not shown.) The plug 20 is configured to connect the headset with an electronic device, e.g., a mobile phone 32. The phone 32 includes a jack 36 into which the plug 20 may be inserted to connect the headset with the phone 32. The phone 32 has a screen 40 mounted in a hard outer shell 44. The hard outer shell 44 is covered by a protective case 48. In various embodiments the protective case 48 may have been purchased by a user as an accessory for the phone 32. The protective case 48 includes an opening 52 aligned with the jack 36.

The body 28 of the plug 20 supports a connector 56 electrically connected with the wires 24 and configured for insertion into the jack 36. In the present example embodiment, the body 28 supports the connector 56 at a generally 90-degree angle, thereby allowing the body 28 to lie generally parallel to the protective case 48, at least near the opening 52, when the connector 56 has been inserted into the jack 36. In some other embodiments, a connector may extend away from a plug body at a generally 180-degree angle, thereby allowing the plug body to extend generally perpendicularly from a protective case when the connector has been inserted into a jack through the protective case. It should be noted that in various embodiments, a plug body could have a shape that is different from the generally lozenge shape of the body 28. Additionally or alternatively, a connector may be connected with a plug body at an angle other than 90 or 180 degrees, dependent, e.g., on shape(s) of an electronic device and/or protective case. In the present example embodiment the connector 56 is a stereo connector having three gold-plated conductors 60 separated by two insulators 64. In other embodiments, however, a connector could have fewer than or more than three conductors and/or could have conductor(s) made of material(s) other than or in addition to gold plating.

Figure 2A:
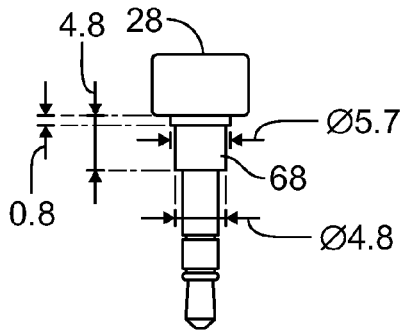
FIG. 2A is a frontal view of a plug in accordance with one example embodiment of the disclosure.
Figure 2B:
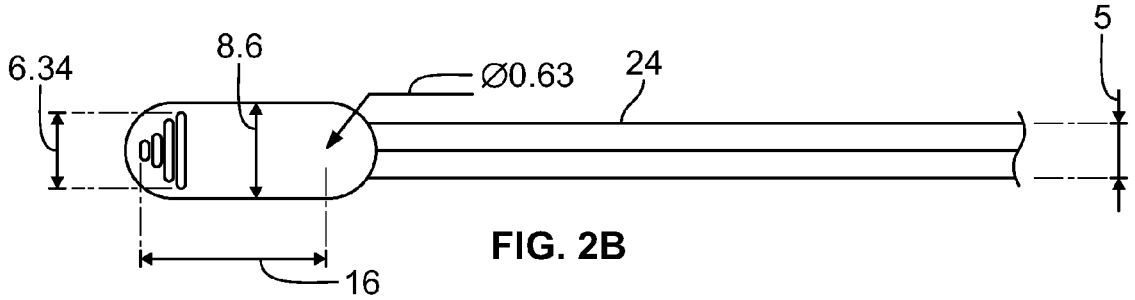
FIG. 2B is a top view of a plug in accordance with one example embodiment of the disclosure.
Figure 2C:
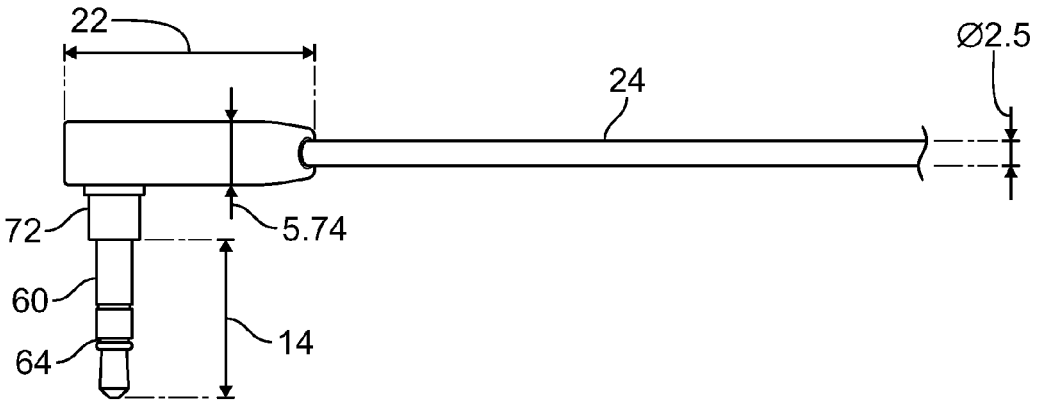
FIG. 2C is a side view of a plug in accordance with one example embodiment of the disclosure.
Figure 2D:
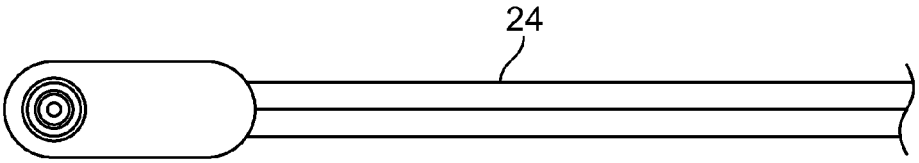
FIG. 2D is a bottom view of a plug in accordance with one example embodiment of the disclosure.
Figure 2E:
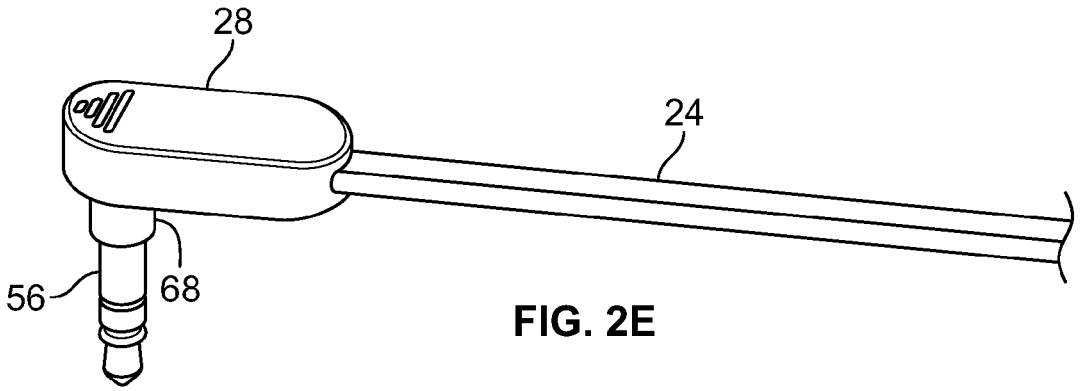
FIG. 2E is a top perspective view of a plug in accordance with one example embodiment of the disclosure.
Figure 2F:
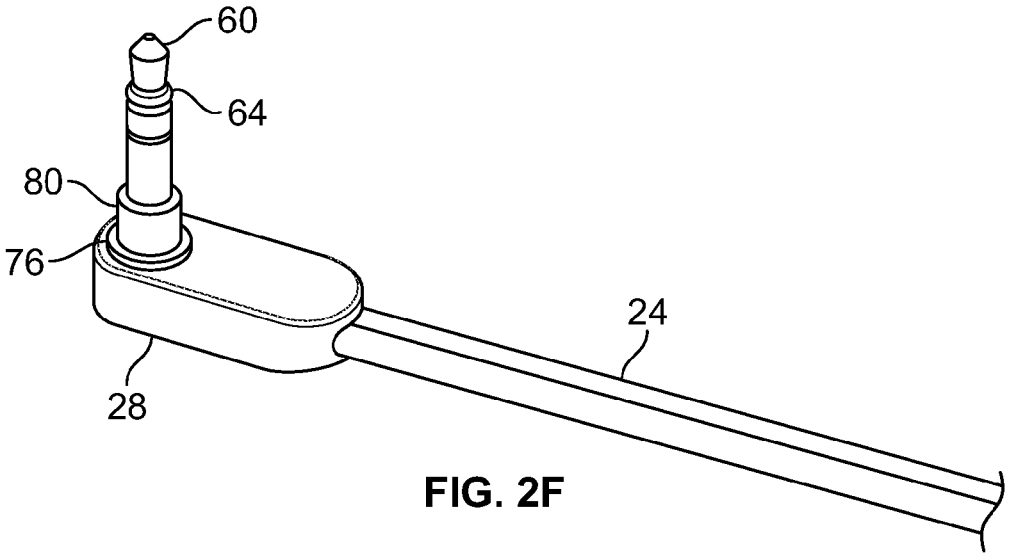
FIG. 2F is a bottom perspective view of a plug in accordance with one example embodiment of the disclosure.

The plug 20 includes an offset member 68 whereby the plug 20 is configured to fit snugly in the opening 52 of the protective case 48 when the connector 56 has been inserted in the jack 36 through the opening 52. In the present example embodiment, the offset member 68 has a stepped profile 72 that includes a shallow portion 76 and a deep portion 80. Offset members could have various profiles and/or various thicknesses, depending on the profile and sizing of an opening provided in a protective case for a jack connection. Additionally or alternatively, offset members could have various profiles, materials, flexibilities and/or various thicknesses depending, e.g., on materials and/or flexibility of materials from which protective cases are made, protective case thickness, etc. Although example millimeter dimensions for the plug 20 and wires 24 are shown in FIGS. 2A-2C, it should be understood that the dimensions shown in FIGS. 2A-2C are examples only. Various dimensions may be provided in various embodiments, in order to accommodate various jacks, various electronic devices, various headsets, various protective cases, etc.

Embodiments of the foregoing plug can eliminate or significantly reduce the interference that most smart phone protective cases can create when a plug is positioned in the smart phone through the case. In various embodiments, the dimensions of an offset member can vary to meet the dimensions of most if not all protective cases that are currently available.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Or, for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A plug comprising:

a connector configured to connect with a jack of an electronic device; and an offset member having a stepped circular profile, wherein the stepped circular profile includes a first circular portion and a second circular portion that has a diameter less than a diameter of the first circular portion, wherein the first circular portion is configured to fit snugly in an opening of a protective case of the electronic device when the connector and the jack are connected through the opening.

2. The plug of claim 1, wherein the offset member is configured to at least reduce interference when the electronic device is in use while in the protective case.

3. The plug of claim 1, further comprising a body supporting the connector and the offset member, the connector positioned through the offset member, and wherein:

the second portion has a thickness greater than a thickness of the first portion.

4. The plug of claim 3, wherein the body and the connector are joined at an angle of 90 or 180 degrees, and wherein:

the first portion has a thickness of about 0.8 millimeters and a diameter of about 5.7 millimeters; and the second portion has a thickness of about 4 millimeters and a diameter of about 4.8 millimeters.

5. The plug of claim 1, wherein the connector comprises gold plating and/or a stereo connector.

6. The plug of claim 1 configured for insertion into the jack regardless of whether or not the electronic device is installed in the protective case.

7. The plug of claim 1 configured for insertion into a phone, wherein:

the first circular portion has a thickness of about 0.8 millimeters and a diameter of about 5.7 millimeters; and the second circular portion has a thickness of about 4 millimeters and a diameter of about 4.8 millimeters.

8. An electronic device comprising the plug of claim 1, wherein the electronic device comprises one or more of:

a headset including headphones or ear buds;

a headset adapter; or a headset extender; or a headset splitter.

9. A plug comprising:

a connector configured for insertion into a jack of an electronic device; and an offset member having a stepped circular profile, wherein the stepped circular profile includes a first circular portion and a second circular portion that has a diameter less than a diameter of the first circular portion, wherein the first circular portion is configured to fit snugly within an opening of a protective case of the electronic device.

10. The plug of claim 9, wherein the offset member is configured to at least reduce interference when the electronic device is in use while in the protective case.

11. The plug of claim 9, further comprising a body supporting the connector and the offset member, the connector extending through the offset member, and wherein:

the second portion has a thickness greater than a thickness of the first portion.

12. The plug of claim 11, wherein the body and the connector are joined at an angle of 90 or 180 degrees, wherein:

the first portion has a thickness of about 0.8 millimeters and a diameter of about 5.7 millimeters; and the second portion has a thickness of about 4 millimeters and a diameter of about 4.8 millimeters.

13. The plug of claim 9, wherein the connector comprises gold plating and/or a stereo connector.

14. The plug of claim 9 configured for insertion into the jack regardless of whether or not the electronic device is installed in the protective case and/or configured for insertion into a phone.

15. An electronic device comprising the plug of claim 9, wherein the electronic device comprises one or more of:

a headset including headphones or ear buds;

a headset adapter; or a headset extender; or a headset splitter.

16. A method of connecting a plug with a jack of an electronic device, the method comprising:

inserting a connector of the plug into the jack through an opening in a protective case of the electronic device; and fitting an offset member of the plug snugly in the opening of the protective case, connecting the plug and the jack of the electronic device by a connector, wherein the offset member has a stepped circular profile, wherein the stepped circular profile includes a first circular portion and a second circular portion that has a diameter less than a diameter of the first circular portion, wherein the first circular portion is fit snugly within the opening of the protective case to at least reduce interference when the electronic device is in use.

17. The method of claim 16, wherein the inserting comprises positioning at least a portion of a body of the plug generally perpendicular to the protective case.

18. The method of claim 16, wherein the inserting comprises positioning at least a portion of a body of the plug at a 180-degree angle relative to the protective case.

19. The method of claim 16, performed to at least reduce interference when the electronic device is in use.

20. The method of claim 16, wherein the electronic device includes a phone.

* * * * *